US009808707B2

(12) United States Patent
Estrada et al.

(10) Patent No.: US 9,808,707 B2
(45) Date of Patent: Nov. 7, 2017

(54) MAGNETIC DOMINOS GAME

(71) Applicants: Isaac Estrada, Rio Rancho, NM (US); Zakkery D. Estrada, Rio Rancho, NM (US)

(72) Inventors: Isaac Estrada, Rio Rancho, NM (US); Zakkery D. Estrada, Rio Rancho, NM (US)

(73) Assignee: XTRIZAK LLC, Rio Rancho, NM (US)

( * ) Notice: Subject to any disclaimer, the term of this patent is extended or adjusted under 35 U.S.C. 154(b) by 0 days.

(21) Appl. No.: 15/184,812

(22) Filed: Jun. 16, 2016

(65) Prior Publication Data

US 2016/0317910 A1 Nov. 3, 2016

Related U.S. Application Data

(63) Continuation-in-part of application No. 15/051,476, filed on Feb. 23, 2016, which is a continuation-in-part of application No. 14/212,427, filed on Mar. 14, 2014, now Pat. No. 9,266,015.

(60) Provisional application No. 61/800,875, filed on Mar. 15, 2013.

(51) Int. Cl.
*A63F 3/00* (2006.01)
*A63F 9/20* (2006.01)

(52) U.S. Cl.
CPC ..... *A63F 9/20* (2013.01); *A63F 3/00694* (2013.01); *A63F 2003/00738* (2013.01)

(58) Field of Classification Search
CPC ..... A63F 3/00
USPC ..... 273/239
See application file for complete search history.

(56) References Cited

U.S. PATENT DOCUMENTS

| | | | | |
|---|---|---|---|---|
| 2,511,774 | A * | 6/1950 | Goldsmith | A63F 3/00694 206/818 |
| 2,570,625 | A | 10/1951 | Zimmerman et al. | |
| 2,665,913 | A | 1/1954 | Hlavac | |
| 2,946,592 | A | 7/1960 | Post | |
| 3,086,778 | A | 4/1963 | Mauer | |
| 3,556,529 | A * | 1/1971 | Noriega | A63F 9/20 273/295 |
| 3,765,679 | A * | 10/1973 | O'Connell | A63F 3/00694 273/239 |
| 4,025,076 | A * | 5/1977 | Lipps | A63F 3/00697 273/294 |
| 4,552,363 | A * | 11/1985 | Rehkemper | A63F 3/00 273/241 |
| 4,834,370 | A | 5/1989 | Noble et al. | |
| 4,834,870 | A | 5/1989 | Osterberg et al. | |
| 5,055,081 | A | 10/1991 | Nayak | |
| 5,393,066 | A * | 2/1995 | Reinitz | A63F 3/00574 273/236 |
| 5,409,236 | A | 4/1995 | Therrien | |

(Continued)

OTHER PUBLICATIONS

"Neodymium magnet", https://en.wikipedia.org/wiki/Neodymium_magnet, Jun. 8, 2016, pp. 1-5.

*Primary Examiner* — Aarti B Berdichevsky
*Assistant Examiner* — Dolores Collins
(74) *Attorney, Agent, or Firm* — Isaac Estrada; Peacock Myers, P.C.

(57) ABSTRACT

A magnetic dominos game set with pieces that magnetically connect end to end, side to side and side to end, and methods for manufacturing and playing magnetic dominos.

6 Claims, 17 Drawing Sheets

(56) References Cited

U.S. PATENT DOCUMENTS

| | | | | | |
|---|---|---|---|---|---|
| 5,478,085 | A * | 12/1995 | Canner | A63F 3/00694 | 273/239 |
| 5,702,105 | A | 12/1997 | Glikmann | | |
| 5,746,638 | A * | 5/1998 | Shiraishi | A63H 33/046 | 446/131 |
| 6,517,070 | B1 * | 2/2003 | Clapera | A63F 9/20 | 273/148 A |
| 6,893,020 | B1 * | 5/2005 | Snyder | A63F 9/20 | 273/287 |
| 7,154,363 | B2 * | 12/2006 | Hunts | H01F 7/0242 | 24/303 |
| 7,668,419 | B2 | 2/2010 | Taverner et al. | | |
| 8,118,306 | B2 | 2/2012 | Kean | | |
| 8,568,186 | B1 | 10/2013 | Sung et al. | | |
| 2009/0243214 | A1 | 10/2009 | Kean | | |
| 2014/0239592 | A1 | 8/2014 | Francis | | |

* cited by examiner

MAGNETIC DOMINOS GAME

CROSS-REFERENCE TO RELATED APPLICATIONS

This application is a continuation-in-part of U.S. patent application Ser. No. 15/051,476, entitled "MAGNETIC DOMINOS GAME", to Estrada et al., filed Feb. 23, 2016, and the specification and claims thereof are incorporated herein by reference; which is a continuation-in-part of U.S. patent application Ser. No. 14/212,427, entitled "MAGNETIC DOMINOS GAME", to Estrada et al., filed on Mar. 14, 2014, issued as U.S. Pat. No. 9,266,015 on Feb. 23, 2016, and the specification and claims thereof are incorporated herein by reference; which claims priority to and the benefit of the filing of U.S. Provisional Patent Application Ser. No. 61/800,875, entitled "MAGNETIC DOMINOS GAME", filed on Mar. 15, 2013, and the specification and claims thereof are incorporated herein by reference.

BACKGROUND OF THE INVENTION

Field of the Invention (Technical Field)

Embodiments of the present invention relate to magnetic dominos game sets. More particularly, they relate to a magnetic dominos game set with pieces that magnetically connect end to end, side to side and side to end, and methods for manufacturing and playing magnetic dominos.

Description of Related Art

In the game of dominos, players match the numbers of pieces and form lines of play of diverse shapes as the game progresses. Normally there is nothing connecting the pieces together, so care must be taken not to disrupt the line of play when playing new pieces. Magnetic dominos available in the market today offer the advantage that they maintain a more stable line of play. These dominos have a magnet at the back face of each piece, which is magnetically attracted to a ferrous metallic surface. The line of play is maintained stable because the pieces attach to the play surface. However, the pieces in these magnetic dominos sets cannot connect to each other on their sides and ends. Thus, the only way for these domino pieces to be magnetically fixed is for the user to play the game on a ferrous metallic surface. When these types of magnetic domino pieces are not on a ferrous metallic surface, they do not maintain a stable, fixed line of play. Therefore, there is a present need for magnetic dominos pieces capable of connecting, not only to a ferrous metallic surface, but also to the sides and ends of other dominos pieces in the set.

The present invention solves this problem by providing magnetic domino pieces capable of magnetically connecting on all sides of the piece, i.e., side to side, end to end, and side to end in addition to being capable of magnetically connecting to a ferrous metallic surface. Methods of manufacturing these magnetic domino pieces are further disclosed.

BRIEF SUMMARY OF THE INVENTION

Embodiments of the present invention comprise a game set of magnetic dominos with a plurality of domino pieces each being formed by the mating of a female half and a male half, such that each piece when fully assembled comprises two ends, two sides, a bottom, and a top, each of the domino pieces further comprising a first and a second cavity disposed at each end of the domino pieces, each of the first and second cavities comprising one magnet, with the first and second cavities being sufficiently larger than the magnets to allow the magnets to move inside when attracted to a magnet of a different domino piece in the game set, or a ferrous metal to form end magnetic connectors disposed at the centers of said ends, each of the domino pieces further comprising a third and a fourth cavity disposed on the sides of each domino pieces, each of the third and fourth cavities comprising one magnet inside and comprising elongated shapes with a length shorter than a total length of the pieces and forming a centrally disposed runway along the sides for the magnets in the third and fourth cavities to move along the sides, the centrally disposed runway comprising a final length of about one half a total length of said pieces, the third and fourth cavities being sufficiently larger than said magnets to allow the magnets to move inside when attracted to a magnet of a different domino piece in the game set, or a ferrous metal, and to form adjustable side magnetic connectors disposed along the sides of the domino pieces and forming adjustable magnetic connections anywhere along the length of said centrally disposed runway, and the domino pieces being magnetically connectable to each other end to end, side to side, side to end, and to ferrous metallic surfaces.

Further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not tube construed as limiting the invention. In the drawings.

DETAILED DESCRIPTION OF THE INVENTION

Figure 1:
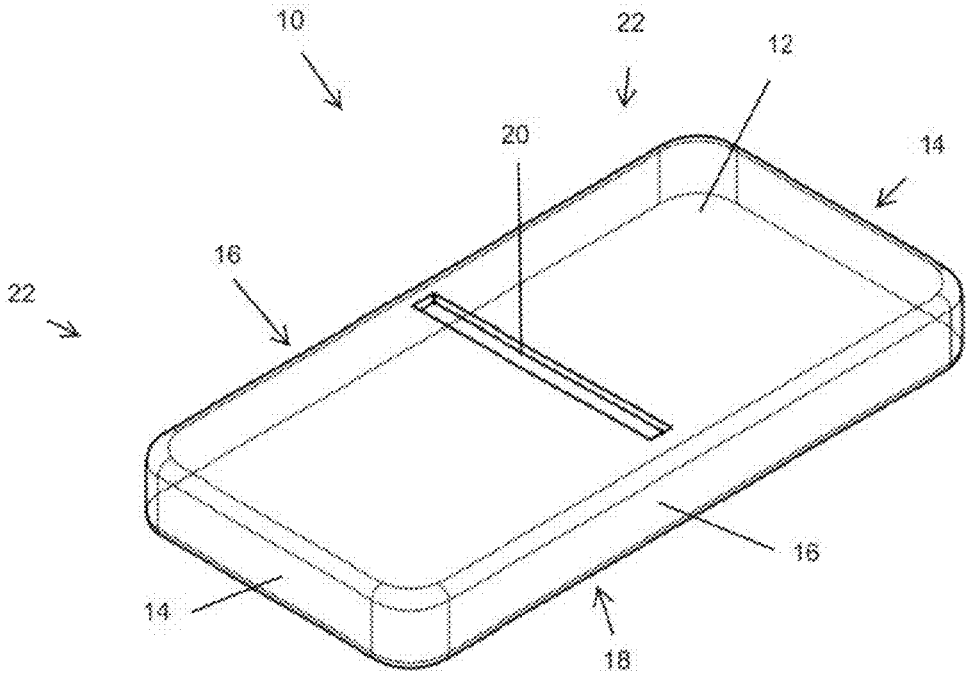
FIG. 1 is a perspective top view of a domino piece.
Figure 2:
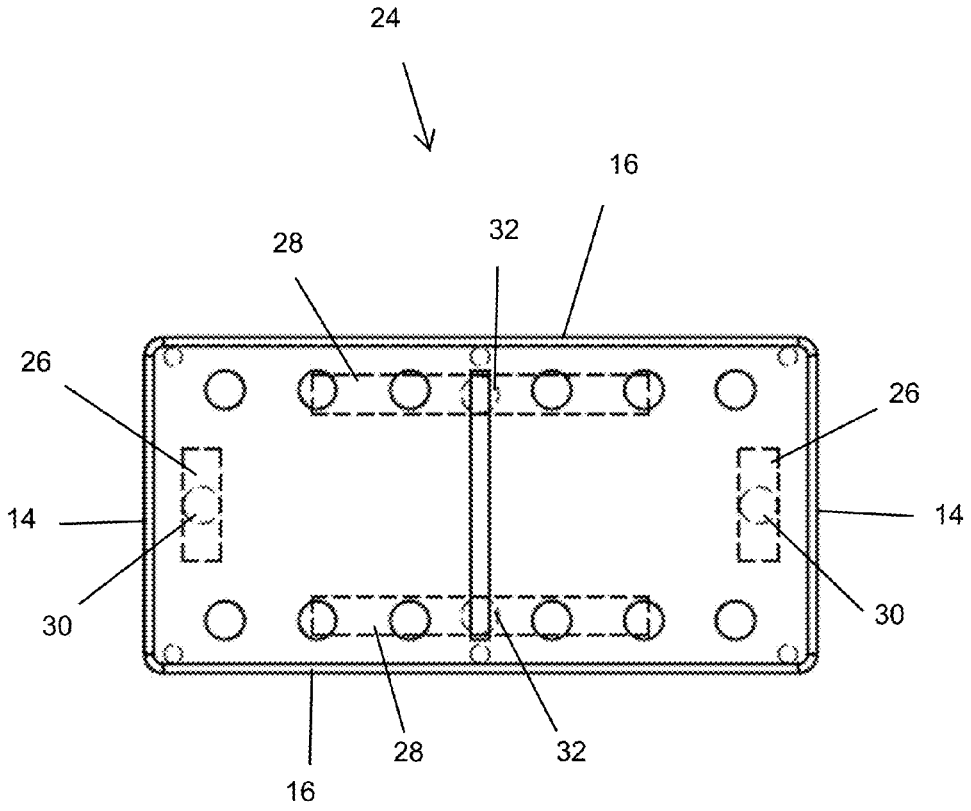
FIG. 2 is a top view of an embodiment of the present invention showing internal cavities with spherical magnets in dotted lines and six circular pips on each side shown in solid lines.
Figure 3:
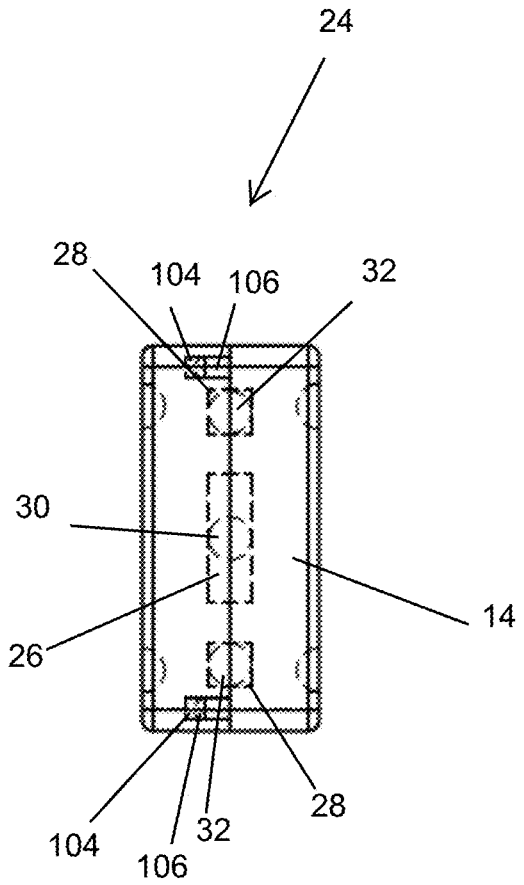
FIG. 3 shows an end of the embodiment of FIG. 2.
Figure 4:
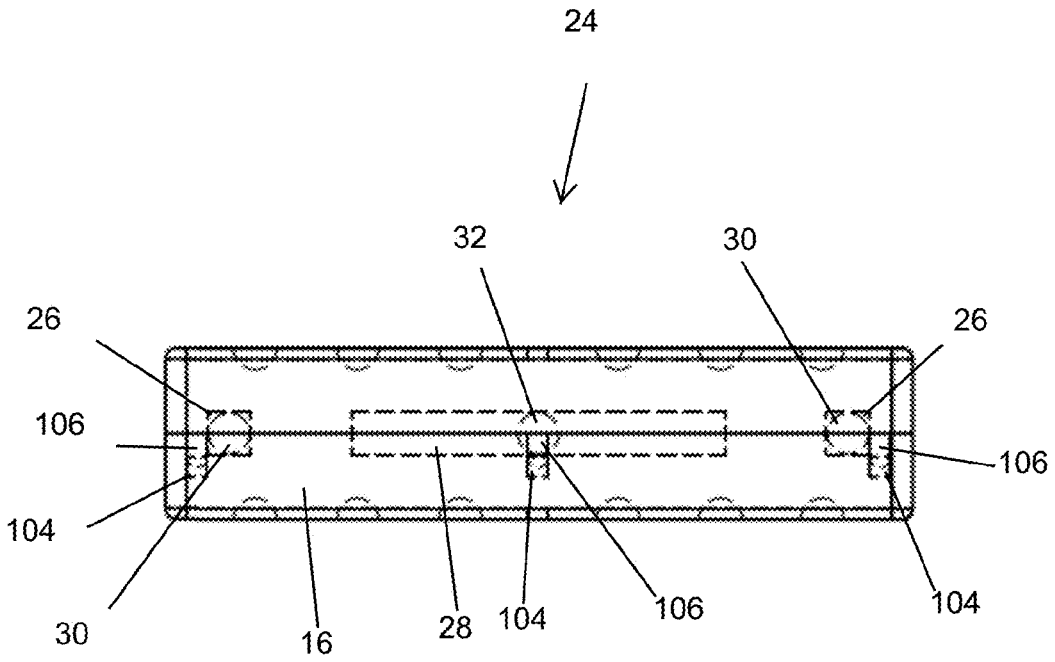
FIG. 4 shows a side of the embodiment of FIG. 2.
Figure 5:
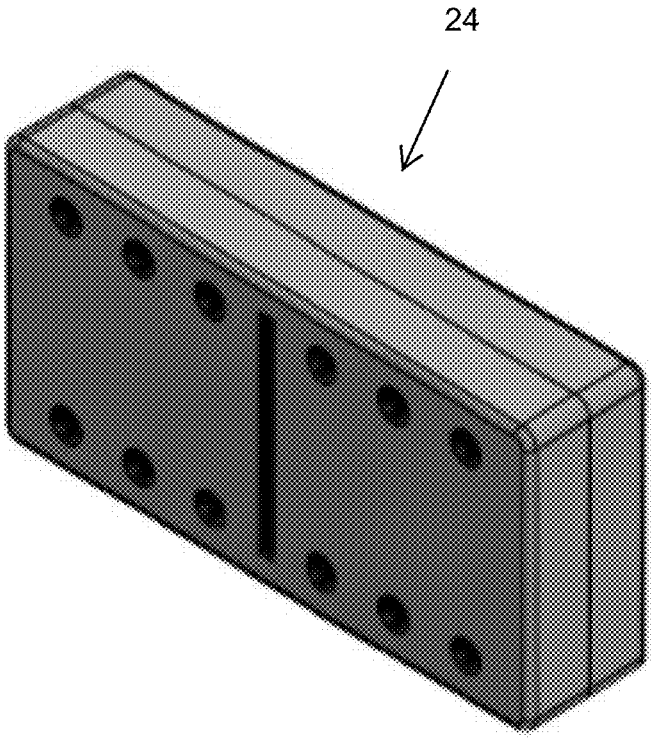
FIG. 5 is a perspective view of the embodiment of FIG. 2 fully assembled.
Figure 6:
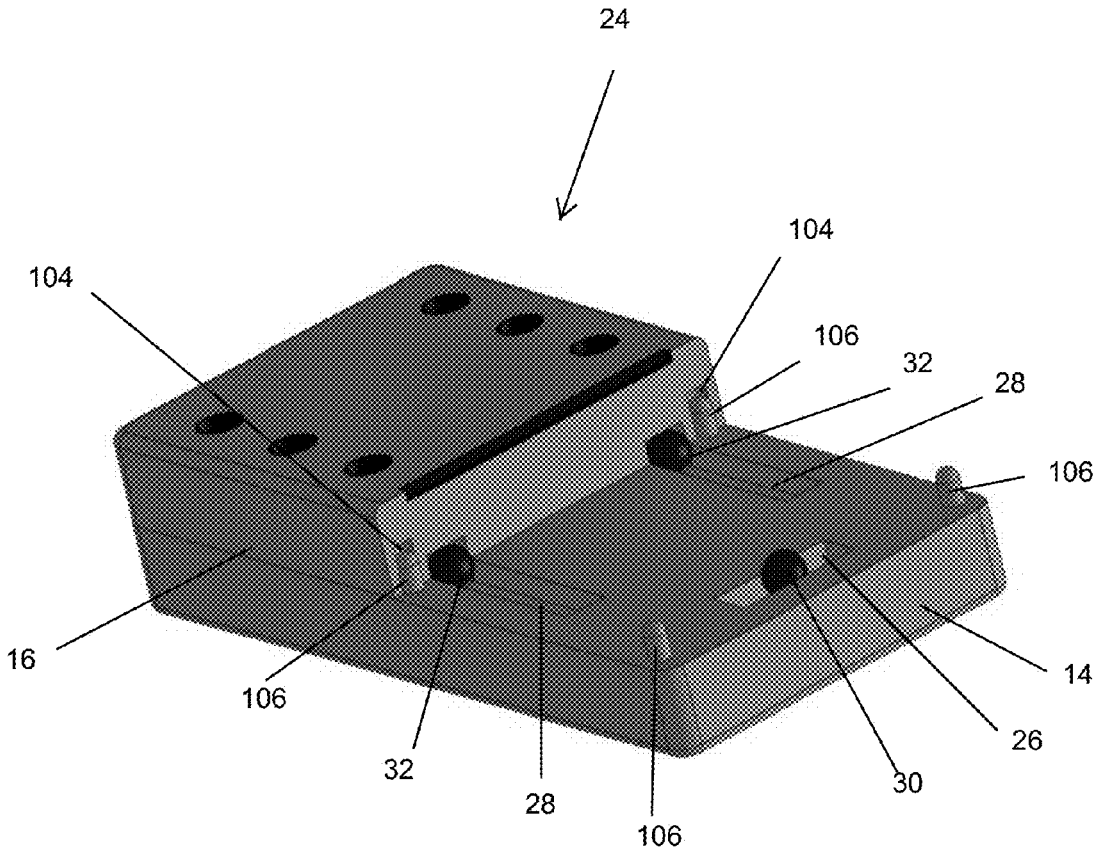
FIG. 6 is the embodiment of FIG. 5 with a partial cut-out to show the internal cavities, magnets, holes and pegs.
Figure 7:
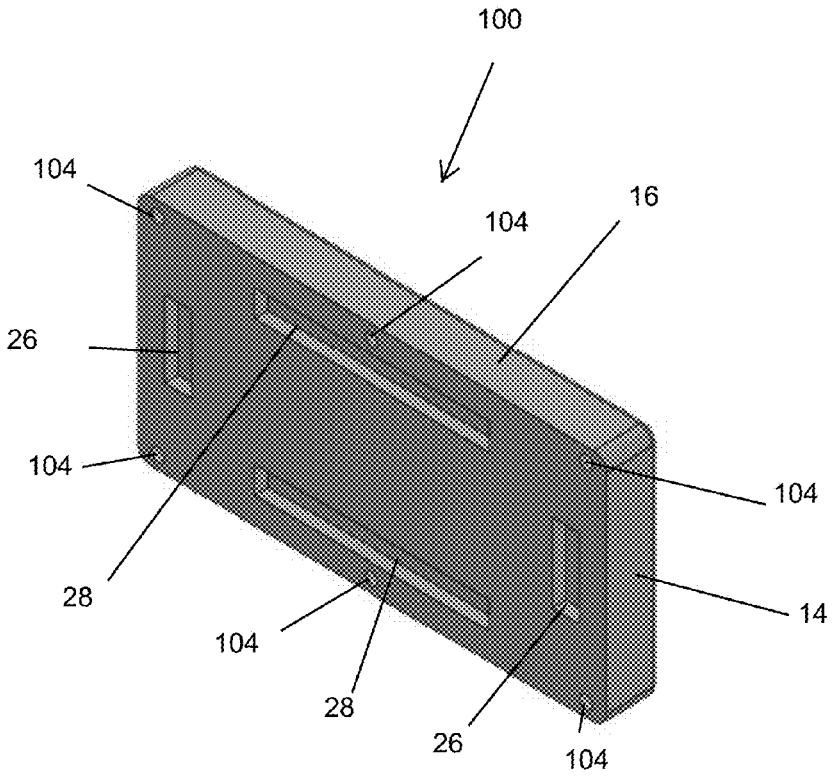
FIG. 7 is a perspective view of the female half of the embodiment of FIG. 2.
Figure 8:
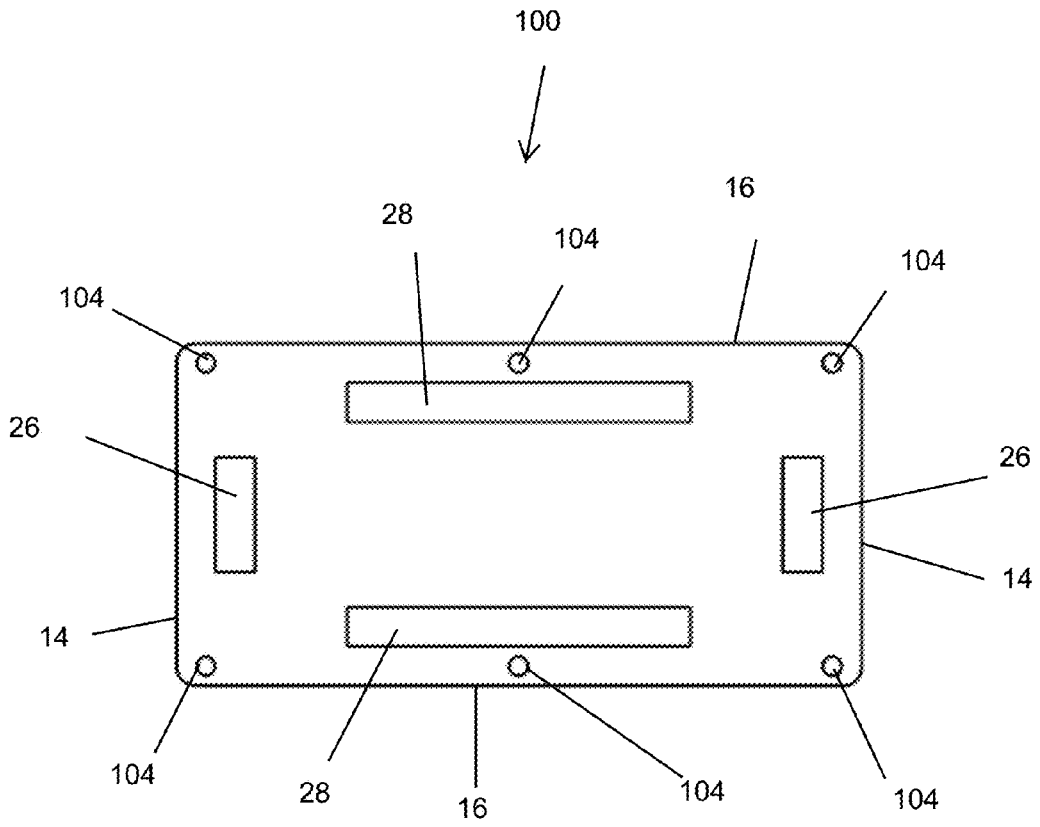
FIG. 8 is a top view of the female half side of FIG. 7 showing the holes and cavities.
Figure 9:
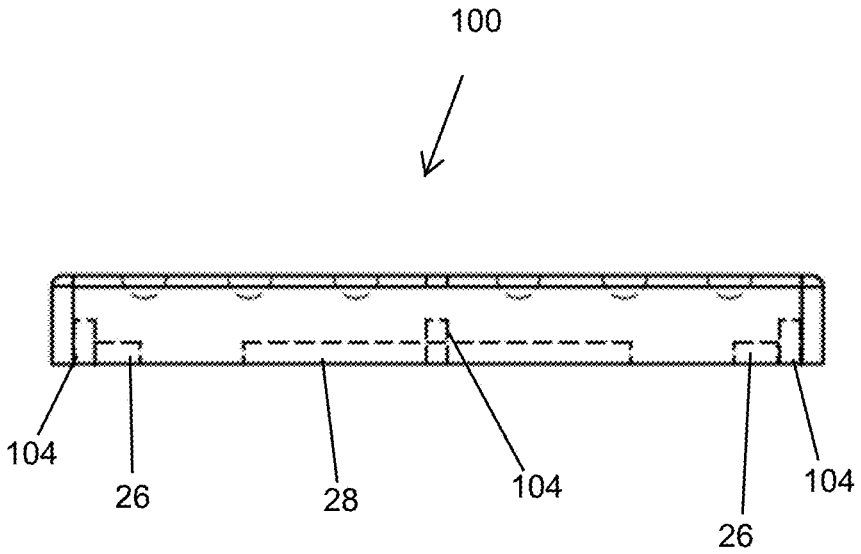
FIG. 9 is a side view of the female half of FIG. 7.
Figure 10:
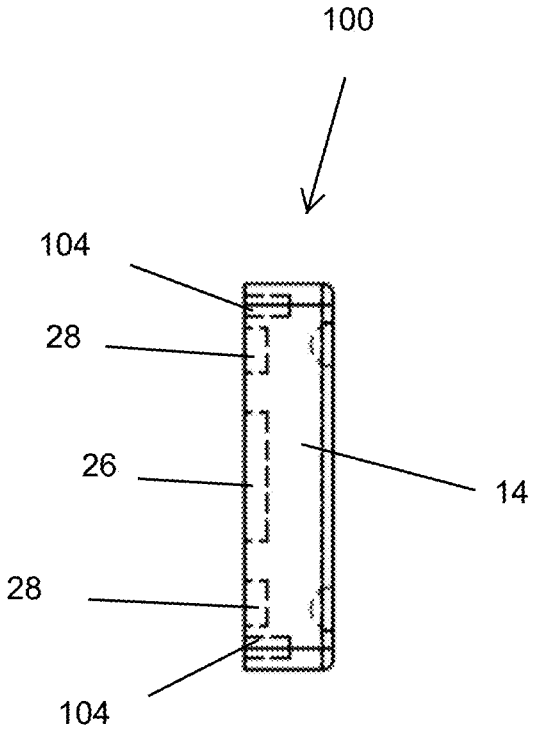
FIG. 10 is an end view of the female half of FIG. 7.
Figure 11:
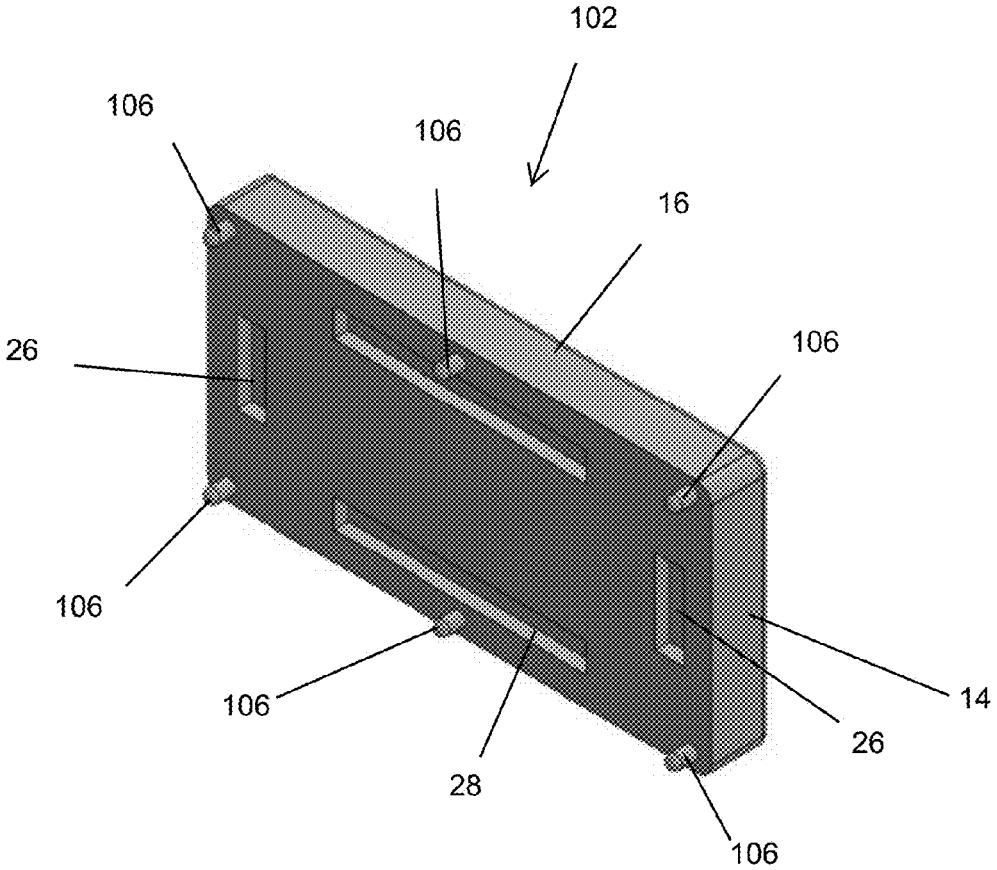
FIG. 11 is a perspective view of the male half of the embodiment of FIG. 2.
Figure 12:
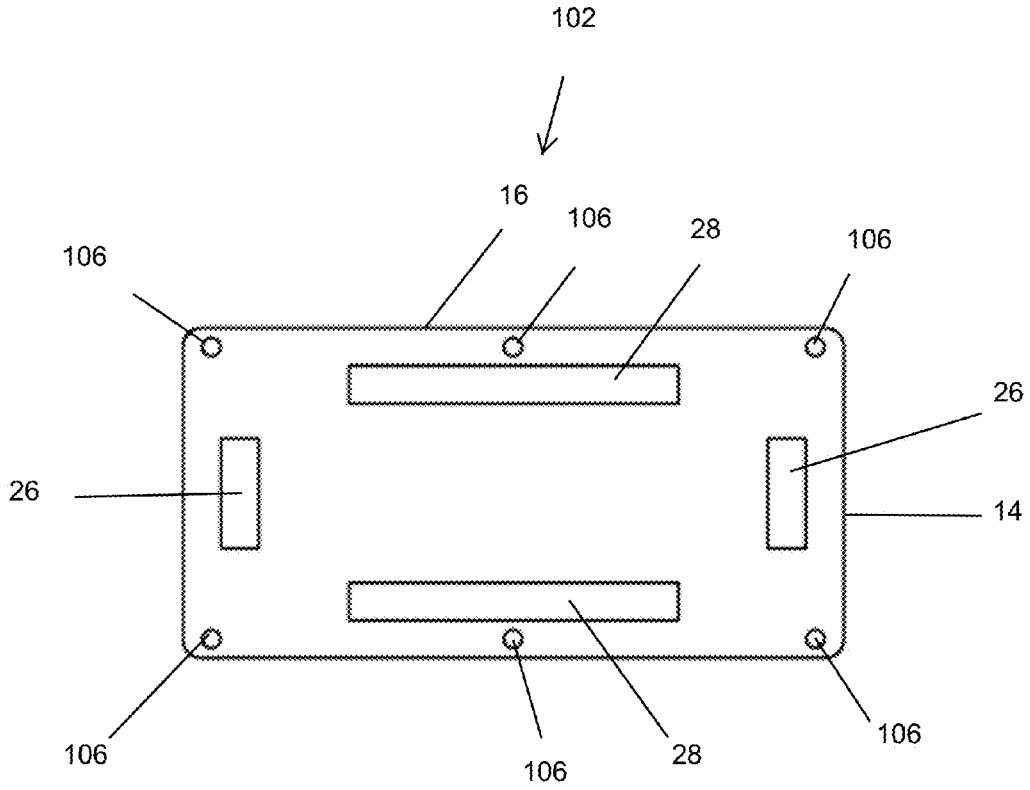
FIG. 12 is a top view of the male half of FIG. 11 showing the pegs.
Figure 13:
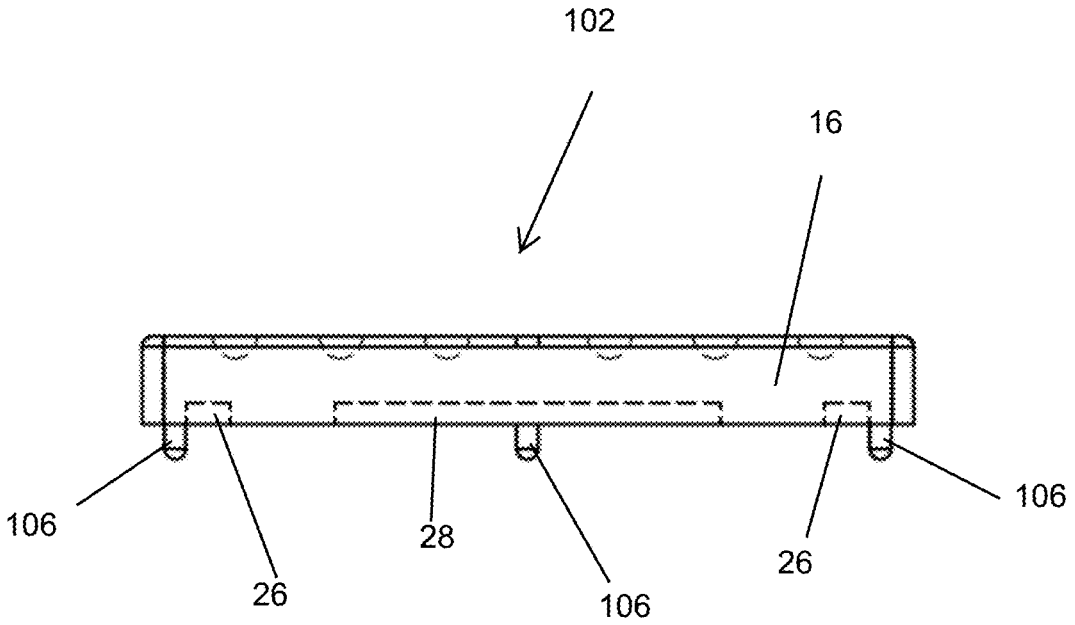
FIG. 13 is a side view of the male half of FIG. 11 showing the pegs.
Figure 14:
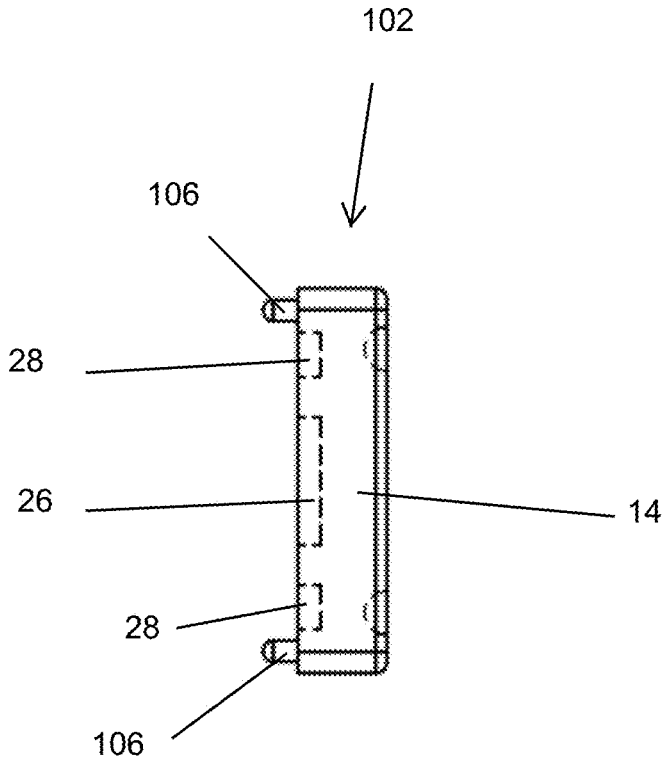
FIG. 14 is an end view of the male half of FIG. 11 showing the pegs.

Referring to the accompanying drawings, and particularly to FIG. 1, there is shown atypical domino piece 10 that is about twice as long as it is wide, comprising top face 12, ends 14, sides 16, and bottom face 18. Top face 12 of domino pieces is normally divided with a ridge, for example, ridge 20, which divides piece 10 into halves 22 of more or less square shape. Each half 22 of piece 10 has a value that is shown through dots or pips.

Although there are variations in modern domino sets, the values of each side typically range from zero to six. Different pieces with the same value on one or both of their halves 22 are said to be of the same suit. Pieces with the same values on both halves 22 are said to be doubles. When a player has a turn, the player adds a matching piece to the line of play.

The rules for the line of play often differ from one variant of the game to another. Sometimes doubles are played sideways and sometimes they serve as spinners, i.e., they can be played on all four sides, causing the line of play to branch out. Sometimes, the first piece is required to be a double, and serves as the only spinner. In some games such as Chicken Foot, all sides of a spinner must be occupied before anybody is allowed to play elsewhere. In Mexican Train and other Dominos Trains games, the game starts with a spinner from which various trains branch off. Most trains are owned by a player, and in most situations players are only allowed to extend their own train.

In one embodiment of the invention, magnetic domino pieces allow players to play the conventional dominos game with the added feature that the pieces connect magnetically to each other on their sides 16 and ends 14, and not simply to a ferrous metallic surface.

Referring now to FIGS. 2-6, an embodiment of the present invention illustrates one of many internal arrangements of magnetic dominos pieces according to embodiments of the present invention. Dominos piece 24 preferably comprises two short cavities 26, and two long cavities 28, which are preferably hollow and comprise magnets 30, and 32, respectively.

Preferably, long cavities 28 preferably encasing magnets 32 to function as a runway along the sides of the piece for the magnets (about ½ the total size of the piece with about ¼ of solid material at each end of the runway), and allows them to move and spin around to align their opposite polarities when the magnets of a different dominos piece come near. This allows the pieces to magnetically connect on their sides anywhere along this runway. Similarly, magnets 30 in cavities 26 can move and spin to align their opposite polarities with the polarity of an approaching magnet to magnetically connect the pieces. This embodiment offers the advantage that all the pieces preferably have only four magnets each, which makes them easier and more affordable to manufacture, and more uniform. All pieces in a set being uniform as to the number and location of their magnets helps prevent cheating when they are being played because the players would not be able to tell doubles apart from the rest of the pieces.

An embodiment of the present invention to manufacture magnetic domino pieces with these aspects comprises molding two halves as female half 100 and male half 102 respectively comprising holes 104 and pegs 106 that mate together to form a fully assembled piece. See FIGS. 5-14. Preferably, magnets 30 and 32 are disposed in the cavities during assembly. A variety of known methods to produce pieces with the appropriate shapes are known in the industry including, but not limited to, injection molding, 3D printing, stereolithography, etc. Multiple materials are suitable for the various processes such as plastics, resins, etc.

Figure 15:
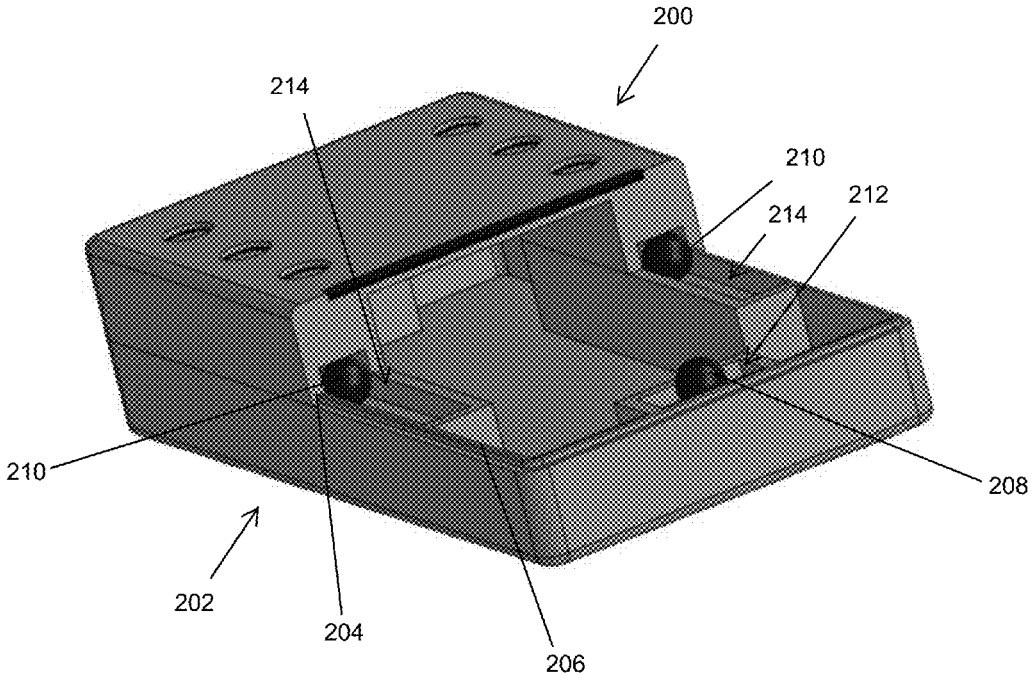
FIG. 15 is a perspective view of a partially sectioned embodiment of the invention comprising a step-joint around the periphery of the halves.
Figure 16:
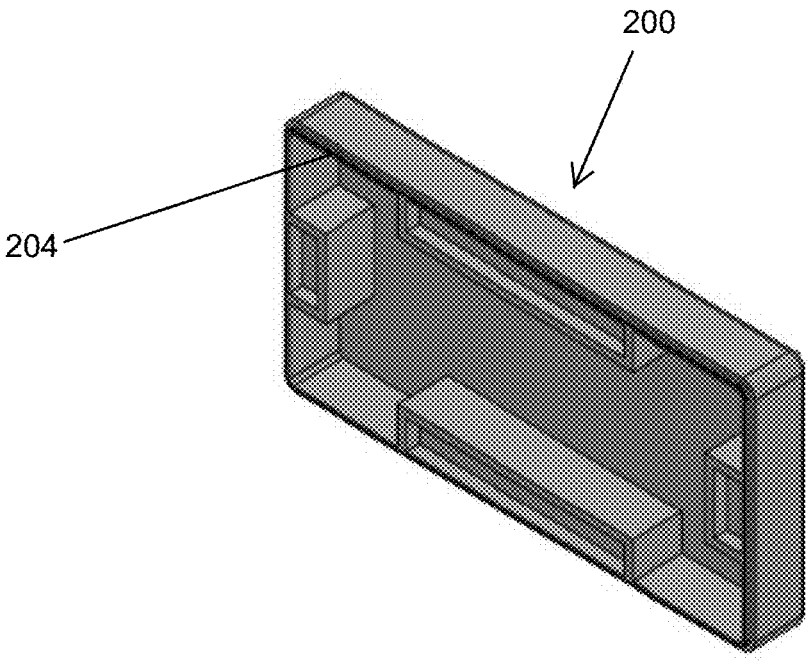
FIG. 16 is a perspective view of the female half of the embodiment of FIG. 15.
Figure 17:
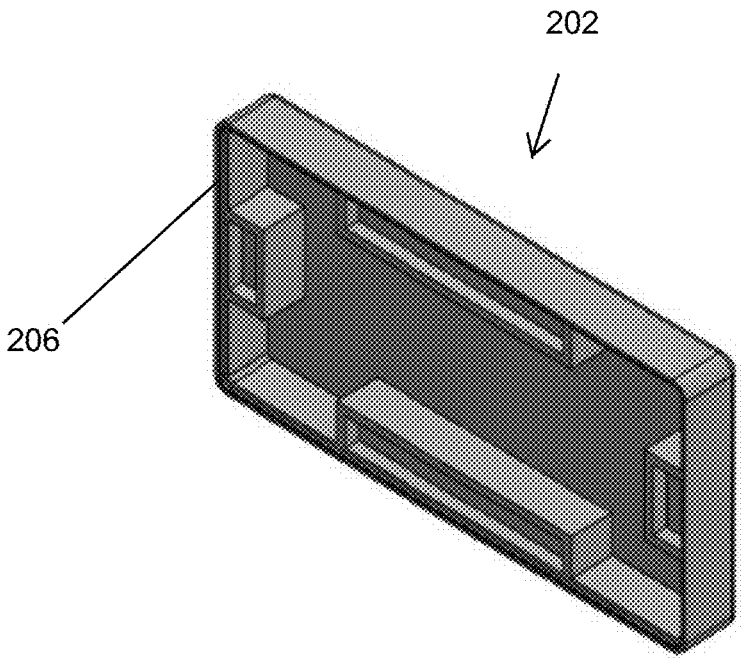
FIG. 17 is a perspective view of the male half of the embodiment of FIG. 16.

In a different embodiment, most of the interior of the pieces is left hollow to reduce cost of manufacturing resources by providing walls that create the cavities to house the magnets. Referring more particularly to FIGS. 15-17, in one embodiment, each piece of a game set of magnetic dominos is made by putting together two halves as female half 200 comprising female step-joint 204 around its periphery and male half 202 respectively comprising male step-joint 206 that mates together with female step-joint 202 to form a fully assembled piece. See FIGS. 15-17. Preferably, magnets 208 and 210 are disposed in the end cavities 212 and side cavities 214 during assembly. A variety of known methods to produce pieces with the appropriate shapes are known in the industry including, but not limited to, injection molding, 3D printing, stereolithography, etc. Multiple materials are suitable for the various processes such as plastics, resins, etc.

INDUSTRIAL APPLICABILITY

The invention is further illustrated by the following non-limiting example.

Example 1

A magnetic dominos game was manufactured out of plastic. The cavities were formed when corresponding female and male halves were assembled. The pieces snapped together through female/male step-joints around the periphery of each corresponding half. Neodymium spherical magnets were placed in the cavities (magnets were smaller than cavities to have room to move) during assembly. A total of four cavities were provided per piece, two short and two long, each contained a spherical magnet. Pips were placed on the pieces in accordance with a typical 28 piece set. The resulting game set had dominos pieces that connected end to end, side to end, and side to side in addition to connecting to metallic surfaces.

The preceding example can be repeated with similar success by substituting the generically or specifically described components and/or operating parameters of this invention for those used in the preceding examples.

Note that in the specification and claims, "about" or "approximately" means within twenty percent (20%) of the numerical amount cited. Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A magnetic dominos game set comprising:

a plurality of domino pieces, each piece being formed by the mating of a separate female half and a separate male half, such that each piece when fully assembled after said mating comprises two ends, two sides, a bottom, and a top;

each of said domino pieces further comprising a first and a second cavity disposed at each end of said domino pieces;

each of said first and second cavities comprising one magnet;

said first and second cavities being sufficiently larger than said magnets to allow said magnets to move inside when attracted to a magnet of a different domino piece in said set, or a ferrous metal to form end magnetic connectors disposed at the centers of said ends;

each of said domino pieces further comprising a third and a fourth cavity disposed on said sides;

each of said third and fourth cavities comprising one magnet inside and comprising elongated shapes with a length shorter than a total length of said pieces and forming a centrally disposed runway along said sides for the magnets in said third and fourth cavities to move along said sides;

said centrally disposed runway comprising a final length of about one half a total length of said pieces;

said third and fourth cavities being sufficiently larger than said magnets to allow said magnets to move inside when attracted to a magnet of a different domino piece in said set, or a ferrous metal, and to form adjustable side magnetic connectors disposed along said sides and forming adjustable magnetic connections anywhere along the length of said centrally disposed runway; and said domino pieces being magnetically connectable to each other end to end, side to side, side to end, and to ferrous metallic surfaces.

2. The magnetic dominos game set of claim 1 wherein said pieces are made of a material selected from the group consisting of plastic, wood, bone, and aluminum alloy.

3. The magnetic dominos game set of claim 1 wherein said magnets are Neodymium magnet.

4. The magnetic dominos game set of claim 1 wherein said magnets are spherical.

5. The magnetic dominos game set of claim 1 wherein said separate female half and said separate male half mate through female and male step-joints.

6. The magnetic dominos game set of claim 1 wherein said separate female half and said separate male half mate through holes and pegs respectively disposed on them.

* * * * *